US011248402B2

(12) United States Patent
Faitl

(10) Patent No.: US 11,248,402 B2
(45) Date of Patent: Feb. 15, 2022

(54) MOTOR VEHICLE DOOR LOCK

(71) Applicant: Kiekert AG, Heiligenhaus (DE)

(72) Inventor: Jan Faitl, Essen (DE)

(73) Assignee: Kiekert AG, Heiligenhaus (DE)

( * ) Notice: Subject to any disclaimer, the term of this patent is extended or adjusted under 35 U.S.C. 154(b) by 754 days.

(21) Appl. No.: 16/075,165

(22) PCT Filed: Dec. 14, 2016

(86) PCT No.: PCT/DE2016/100585
§ 371 (c)(1),
(2) Date: Aug. 3, 2018

(87) PCT Pub. No.: WO2017/133717
PCT Pub. Date: Aug. 10, 2017

(65) Prior Publication Data

US 2021/0198924 A1 Jul. 1, 2021

(30) Foreign Application Priority Data

Feb. 3, 2016 (DE) ..... 10 2016 101 885.6

(51) Int. Cl.
*E05B 81/36* (2014.01)
*E05B 81/06* (2014.01)
*E05B 81/14* (2014.01)

(52) U.S. Cl.
CPC ..... *E05B 81/36* (2013.01); *E05B 81/06* (2013.01); *E05B 81/14* (2013.01); *E05Y 2900/531* (2013.01)

(58) Field of Classification Search
CPC ..... E05B 81/06; E05B 81/14; E05B 81/18; E05B 81/30; E05B 81/34; E05B 81/36; Y10T 292/1079
See application file for complete search history.

(56) References Cited

U.S. PATENT DOCUMENTS 4,518,180 A * 5/1985 Kleefeldt ..... E05B 81/06 292/201
6,168,215 B1 * 1/2001 Kodama ..... E05B 81/06 292/201

(Continued)

FOREIGN PATENT DOCUMENTS

DE 19547724 6/1997
DE 19614122 10/1997

(Continued)

OTHER PUBLICATIONS

Sep. 29, 2011 Machine translation of DE 102010003361 A1 (Year: 2011).*

(Continued)

*Primary Examiner* — Kristina R Fulton
*Assistant Examiner* — Christopher F Callahan
(74) *Attorney, Agent, or Firm* — Renner, Otto, Boisselle & Sklar, LLP

(57) ABSTRACT

A lock for a motor vehicle includes a locking mechanism with a rotary latch and at least one pawl, a drive motor, a worm connected to the drive motor, a worm gear, wherein the worm gear can be driven by the drive motor and with the aid of the worm, and a transmission stage for transmitting a torque from the worm gear to a pawl, wherein the transmission stage is a gear stage.

20 Claims, 3 Drawing Sheets

(56) References Cited

U.S. PATENT DOCUMENTS

| | | | | |
|---|---|---|---|---|
| 6,371,536 | B1 * | 4/2002 | Koerwer | E05B 81/14 292/201 |
| 7,234,736 | B2 * | 6/2007 | Kachouh | E05B 81/14 292/201 |
| 9,758,992 | B2 * | 9/2017 | Kouzuma | E05B 81/14 |
| 2005/0052032 | A1 * | 3/2005 | Ilea | E05B 81/25 292/216 |
| 2014/0175809 | A1 * | 6/2014 | Takeuchi | E05B 81/06 292/96 |

FOREIGN PATENT DOCUMENTS

| | | | | |
|---|---|---|---|---|
| DE | 19906997 | | 8/2000 | |
| DE | 10055378 | | 5/2002 | |
| DE | 10319744 | | 11/2004 | |
| DE | 69734211 | | 6/2006 | |
| DE | 102006002850 | | 9/2006 | |
| DE | 202006017591 | | 2/2007 | |
| DE | 102007045225 | | 2/2008 | |
| DE | 102010003361 | A1 * | 9/2011 | F16H 55/088 |
| EP | 1739258 | | 1/2007 | |

OTHER PUBLICATIONS

Sep. 9, 2011 Machine translation of DE 102010003361 A1 (Year: 2011).*

Search Report of DE Application No. 102016101885 dated Sep. 23, 2016.

International Search Report and Written Opinion for corresponding Patent Application No. PCT/DE2016/100585 dated Oct. 5, 2017.

* cited by examiner opening movement end position not engaged

MOTOR VEHICLE DOOR LOCK

FIELD OF DISCLOSURE

The invention relates to a lock for a motor vehicle, in particular a lateral door lock, comprising a locking mechanism with a rotary latch and at least one pawl, a drive motor, a worm connected to the drive motor, a worm gear, wherein the worm gear can be driven by the drive motor and with the aid of the worm and a means to transmit a drive torque of the worm gear to a pawl.

BACKGROUND OF DISCLOSURE

In a lock for a motor vehicle, which is also referred to as a locking system, a locking mechanism is usually installed, wherein the locking mechanisms consist of a rotary latch and at least one pawl. The rotary latch located in the lock interacts with a lock holder. The lock holder is either attached to the chassis of the motor vehicle or the door, flap, sliding door, etc. During a relative movement between the rotary latch and the lock holder the rotary latch is pivoted and simultaneously engaged with the pawl, whereby the locking mechanism is locked. The pawl is usually pre-tensioned by a spring, according to the embodiment.

In order to initiate an opening process, i.e. unlocking of the lock, a triggering lever is used according to the lock construction. During operation of the triggering lever, the pawl is disengaged from the rotary latch, so that the rotary latch can execute a pivoting movement again. The rotary latch is hereby moved mainly by means of a spring element and/or on the basis of tensile stress resulting from the lock holder and/or from the force of the door seal. An operating lever is used to operate the triggering lever. The operating lever can be an internal operating lever or an external operating lever, for example.

Some lock variants no longer have a triggering lever, the locking mechanism is operated by means of an electrical drive here. A pertaining door handle can have an electrical switch, for example, by means of the operation of which a signal is transmitted to an electromotor. A worm gear transmission is preferably used to open the locking mechanism, consisting of an electromotor, a worm and a worm gear, as a very great transmission ratio can be achieved here. A worm gear transmission enables very precise control of the locking mechanism, while providing high triggering forces.

Purely electrical locks may have no mechanical connection between the external door handle or the internal door handle and the locking mechanism, wherein the safety function to open the locking mechanism an accident and potential outage of electrical supply energy may be provided by means of an additional battery and/or further electrical components. Other locks which are not purely electric contain a mechanical connection between the external door handle or the internal door handle and the locking mechanism as a safety function to open the locking mechanism after an accident.

From DE 19 614 122 A1 a motor vehicle flap lock or door lock is known which comprises a drive element consisting of an electromotorized worm drive with a drive spindle and a worm gear, a tappet, a pawl and a rotary latch. The tappet is located on the worm gear and is moved during movement of the drive against an operating surface on the pawl. The pawl is configured as a double-sided lever, wherein the lever is pivotably accommodated around an axis. A ratchet nose located on the side of the pawl lever turned away from the drive element engages into a main ratchet on the rotary latch when the lock is locked and thus prevents the rotary latch from making a pivot movement. The rotary latch is mounted around an axis. By moving the tappet against an operating surface of the pawl, the pawl lever moves around its axis, so that the ratchet nose of the pawl is moved out of the main ratchet of the rotary latch.

Furthermore, a motor vehicle door latch with an electronic opening drive has become known from DE 10 319 744 A1. Two electromotors which sit on a common shaft drive a worm gear by means of a worm. A tappet pin is located on the worm gear, wherein the tappet pin is moved against the pawl during operation of the electromotors and thus the worm gear. The pawl is constructed as an L-shaped lever with two lever legs, wherein a rotary axis is attached in the intersection point of the two lever legs. If a movement is exerted on the pawl by the tappet pin, the pawl rotates around the axis and disengages from a rotary latch.

A bolting arrangement for motor vehicle doors is known from DE 69 734 211 T2. On the one hand, a figure is described in which an electromotor drives a gear wheel. A pin is arranged on the gear wheel, wherein the pin moves the pawl during a rotary movement of the gear wheel. The pawl is L-shaped and pivotably mounted around an axis. During operation of the pawl by the pin, the pawl moves out of a main ratchet position on the rotary latch. A further figure of this patent describes an electromotor, wherein the electromotor moves a gear rack by means of a gear wheel. This gear rack acts on a pawl mounted around an axis with one end. During movement of the gear rack on the pawl the pawl is moved out of the main ratchet of a rotary latch. The retraction of the gear rack into a starting position is caused on the one hand by an externally induced torque on the rotary latch and/or on the other hand by a spring attached to the gear rack.

The locking systems known from the state of the art are usually based on a bolt located on a worm gear being moved against a lever-type pawl, wherein the pawl is pivotably mounted on an axis. Due to the force acting on the pawl, the pawl is placed into a pivot movement and a ratchet nose located on the pawl is disengaged from a rotary latch. The force transmitted by the bolt to the pawl usually has no uniform force progression as during the movement process the position of the bolt changes and a change to the lever ratios on the pawl also occurs, so that the induction force of the bolt on the pawl varies.

SUMMARY OF DISCLOSURE

The object of the invention is to provide an improved locking device. It is also an object of the invention to guarantee a safe and uniform force transmission between the worm gear and the pawl, so that in the case of operation of the pawl continual engagement is present between the worm gear and the pawl. It is also an object of the invention to guarantee a structurally simple and cost-effective possibility for safe and definable force transmission.

The object is solved according to the invention by the characteristics of the disclosure. Preferred embodiments of the invention are stated in the disclosure. It is pointed out that the exemplary embodiments described hereafter are not restrictive; instead, any possible variations are possible of the characteristics described in the description and the drawings are possible.

The object of the invention is solved therein, that a lock for a motor vehicle, in particular a lateral door lock, is being provided, comprising a locking mechanism with a rotary latch and at least one pawl, a drive motor, a worm connected to the drive motor, a worm gear, wherein the worm gear can be driven with the drive motor and with the aid of the worm and a means to transmit a torque of the worm gear to a pawl, wherein the means to transmit a transmission stage is preferably a gear stage.

With the formation of a transmission stage to transmit the drive forces between a worm gear and a pawl according to the invention, the possibility is now created of guaranteeing a safe and definable force transmission between the worm gear and the pawl.

A transmission is a mechanical construction, wherein the purpose of a transmission is to transfer and/or transmit forces, torques rotary directions or revolutions. Transmissions have different designs, in which force transmission occurs, for example, by means of positive-locking or force-fitting constructions. The gear stage transmission has a configuration of the positive-locking transmission. Gear stage transmissions have the advantage that the toothed flanks of the gear wheels are permanently engaged, so that during the movement process and first and foremost when there are changes to the rotational direction no or only slight play occurs between the teeth of the gear wheels, whereby by means of gear stage transmissions a very secure and defined transmission process is ensured. This safe and defined transmission process should also be executed during transmission of a drive force on a gear wheel or a gear wheel segment on a pawl.

The transmission stage, which results between the gear wheel and the pawl, can be structurally configured such that by interaction of a sufficiently dimensioned electromotor with the transmission stage the necessary opening force is applied, so that during operation of the pawl by the gear wheel a ratchet nose of the pawl can be disengaged from a rotary latch.

The lock for a motor vehicle also encompasses such locks which are used, for example, in sliding doors, tailgates, flaps or covers, such as a top cover, in addition to the lateral door lock. The core elements of such a lock are constituted by the components, called a locking mechanism, rotary latch and pawl, wherein the locking mechanism can be formed with a pre-ratchet and/or a main ratchet. The pre-ratchet and the main ratchet constitute two different stop surfaces on the rotary latch, to which the pawl during a locking process of the lock, for example a motor vehicle door lock, ratchets in and thus prevents independent opening of the rotary latch.

The ratchet nose of the pawl engages during a locking process of the lock initially with the stop surface of the pre-ratchet and during the further locking process of the lock with the stop surface of the main ratchet. A locking process of the lock, for example, a motor vehicle lock, is understood to mean the movement of, for example, a motor vehicle door, in the direction of the chassis or the latch holder due to an impulse acting externally. Understandably, the movement of another door, flap and/or cover in the direction of the chassis or lock holder can also be understood thereby.

The rotary latch comes into contact with the lock holder during the locking process of the lock. Due to the movement of the lock in the direction of the chassis, the rotary latch moves against the lock holder, whereby the rotary latch executes a rotational movement around the rotary latch axis and clasps the lock holder, at least partly. In order to prevent independent opening of the rotary latch after ending of the locking process, i.e. the external impulse, the pawl ratchets with its ratchet nose in the main ratchet of the rotary latch. One or two pawls can be used on a rotary latch.

An opening movement of the lock is usually executed by operation of an internal or external door handle or, dependent on the embodiment of the door, flap or cover by an opening mechanism which is of a different design. By means of the operation of an internal or external door handle or according to the embodiment of the door, flap or cover, by an opening mechanism of a different design, either a mechanism is operated which acts on the pawl, or an electrical signal is triggered, whereby the electrical signal actuates an electromotor. During actuation of an electromotor by means of an electrical signal, the drive torque exerted by the electromotor is transmitted to a worm gear by means of a worm. In turn, the worm gear acts on the pawl and thus disengages the pawl from the rotary latch.

In a preferred embodiment, the pawl has a pawl body and a at least sectoral toothing. Toothing on the pawl has the advantage that, by means of the toothing, direct engagement of a gear wheel or a gear wheel segment is possible on the pawl. Furthermore, the toothing on the pawl enables a small dimension of the pawl as no lever arm is necessary to trigger the pawl.

A further embodiment of the pawl can also be a combination of a pawl body of the pawl, a rotary axis and a toothing element. The toothing can be configured both circumferentially and also only sectorally.

In a further embodiment of the invention the toothing is connected to the pawl body in a positive-locking, force-fitting or firmly bonded manner. This embodiment implies that the pawl consists of more than one component and is produced in at least one processing step in a positive-locking, force-fitting or firmly bonded manner. The advantage resulting from a pawl with at least two components is that the individual components can have a simple contour which leads to cost-effective production of the individual components. Furthermore, by means of the separate design of the pawl body and the toothing or the toothing element the possibility exists of attaining a greater diversity of variants within the product range. Thus, for example, different pawl types can be combined with a toothing element.

A positive-locking connection of the pawl body with a toothing element can be understood to mean, for example, that a contour is attached in and/or on the pawl body, wherein a toothing element is connected in a positive-locking manner with the contour on the pawl body. Other positive-locking connection options are also conceivable between the pawl body and the toothing element. Positive-locking connections are also conceivable between the pawl body and the toothing element, which use a component known from machine elements, such as pins, wedges or splints, for a positive-locking connection.

A positive-locking connection of the pawl body with a toothing element can be understood to mean, for example, a connection by means of screwing and/or clamping. A positive-locking connection of the pawl body with the toothing element can also be understood to mean a press or snap connection. Other positive-locking connections are naturally also conceivable.

A permanent connection by means of welding, gluing, soldering or vulcanizing can be understood to mean a firmly bonded connection of the pawl body with a toothing element.

If the toothing is formed as a single component with the pawl, a further advantageous embodiment of the invention thus results. A single-component embodiment of the pawl enables quick and easy production as only production of the pawl is necessary and no further processing step is required to combine different components. Furthermore, the single-component embodiment of the pawl offers the advantage that no incorrect component combinations are possible. If the pawl consists of more than one component and if the individual components are mounted in different possible combinations, an incorrect combination of a pawl body and a toothing element can be used, for example.

In a further embodiment of the invention the pawl consists of a metallic material, preferably a stamping or injection-molded component and/or plastic, preferably from a metallic pawl body with an at least partial plastic layer. A stamping component is understood to mean that a raw body is changed in shape by means of a force applied externally and/or its shape is changed by a separation process. This can be executed in one or several steps.

A molded or injection molded component is understood to mean a component produced from a raw material and by means of a casting process. The injection-molding process is different as a material is sprayed into an injection mold in a pressurized manner. The end product of this spray casting process, i.e. the molded component produced, can often be used directly and can be cost-effectively produced in large quantities. The spray casting process is predominantly used for plastic components.

In relation to the manufacture of the pawl different variants are possible. The entire pawl body including the toothing can be produced as a cast component. Manufacture of the pawl from plastic by means of the injection molding process is also conceivable. The combination of a metallic pawl basic body with a plastic toothing and/or different plastic elements is also conceivable. Further possible combinations which result from the materials of metal and plastic are also conceivable.

If an at least sectoral plastic layer encompasses toothing, a further embodiment of the invention results. A sectoral plastic layer should be understood to mean here that a plastic layer is applied and/or integrated on and/or in a basic body which encompasses the basic body at least in part. The toothing should be attached on a partially present plastic layer in order to enable operation of the pawl by means of a gear wheel or gear wheel segment. The toothing can also only be arranged in a certain area.

In a further advantageous embodiment, the worm gear encompasses a worm gear segment. In the invention present here the worm gear constitutes the connection between the electromotor, with the attached worm, and the pawl. The worm gear functions as a transmission element in the gearbox resulting between the worm, the worm gear and the pawl. The drive torque of the electromotor is thus transmitted to the pawl by means of the worm gear.

The worm gear has a toothing, preferably an oblique toothing, which engages with the worm. The worm gear is arranged on an axis, wherein the axis permits a rotational movement of the worm gear with at least a bearing point. Furthermore, the worm gear has a gear wheel segment, wherein the gear wheel segment is attached to the worm gear and is engaged with the pawl. The gear wheel segment can have a circumferential toothed contour and also only a partially arranged toothed contour in its shape. The advantage of a worm gear with an attached gear wheel segment is that secure and accurate transmission of the forces is possible from the drive motor to the pawl.

If the gear wheel segment is arranged in parallel to the worm gear, a further advantageous embodiment of the invention thus results. An advantage resulting from the parallel design of the worm gear and the gear wheel segment is that a very small design of the worm gear and the gear wheel segment is possible. An embodiment of the worm gear with a gear wheel segment can be that the toothed contours of the gear wheel segment protrude over the toothed contours of the worm gear, whereby the pawl can be arranged directly over the worm gear. However, other embodiments are also conceivable.

In a further advantageous embodiment, the worm gear segment is connected to the worm gear in a force-fitting or firmly bonded manner. In this embodiment, the worm gear and the gear wheel segment consist of at least two components which are combined in at least one processing step in a positive-locking, force-fitting or firmly bonded manner. The advantage resulting from the combination of individual components worm gear and gear wheel segment is that the individual components of the worm gear and the gear wheel segment have a simple contour which leads to cost-effective production of the individual components. Furthermore, due to the separate design of the worm gear and the gear wheel segment, the possibility exists of attaining a greater diversity of variants within the product range. Different worm gears can thus be combined with different gear wheel segments, for example. By means of the combination of different worm gears with different gear wheel segments different combinations can also be attained for different transmission ratios very flexibly and cost-effectively.

A positive-locking, force-fitting or permanently bonded connection of the worm gear and the gear wheel segment can analogously be understood to mean the same as a positive-locking, force-fitting and/or permanently bonded connection of the pawl body with a toothing element. The single-component formation of the worm gear can also be understood analogously as the single-component embodiment of the pawl. This should not be understood to mean an identical geometric shape, but a similar connection or characteristic shapes.

In a further advantageous embodiment, the gear wheel segment extends over an angle range of 20°-120°, preferably 30°-45°, of the worm gear. By means of the configuration of the angle range of 20°-120°, preferably 30°-45°, of the worm gear, the advantage results that the gear wheel segment is arranged solely in the range necessary for use. By means of this configuration, both material and thus weight and installation space can be saved. Furthermore, by means of configuration of the gear wheel segment in only a certain angle range of the worm gear, the mass characteristics of the gear wheel segment can be used for the opening process of the lock. For example, during the opening process of the lock a focus relocation of the gear wheel segment on the worm gear can be configured to create a structural advantage, in particular to assist in the opening process.

If a toothing of the gear wheel segment of the worm gear is formed in such a way that toothing of the gear wheel segment and the toothing is attained on the pawl, wherein in particular a reducing toothing is formed on the gear wheel segment, a further advantageous embodiment of the invention thus results. A reducing toothing is understood to mean that the external teeth of the gear wheel segment on at least one side of the gear wheel segment have a progression of the teeth contour reducing in height. This has the advantage that during a gear wheel segment which is only configured over an angle range on the worm gear which engages the teeth of the gear wheel segment with the teeth of the pawl. Damage to the teeth contour of the gear wheel segment and the pawl is thus prevented.

In a further advantageous embodiment of the invention, the worm gear and the gear wheel segment consist of a metallic material and/or a plastic, preferably polyoxymethylene (POM). Different possible combinations result which can be used differently dependent on the application and the construction of the worm gear, whether from one or several components. For example, the worm gear and the gear wheel segment can be configured as a single component and consist of a metallic material or a plastic. It is also conceivable that the worm gear and the gear wheel segment consist of more than one component and thus, for example, the gear wheel segment is plastic and integrated into the worm gear and/or around the worm gear, at least partially. Further possible combinations resulting from the implementation of a constructive solution are naturally also conceivable.

In a further advantageous embodiment of the invention the worm gear has a metallic rotary axis. As the drive forces are transmitted between the drive motor and the pawl by means of the worm gear, especially high transmission forces act on the worm gear. In order to guarantee secure transmission of the forces from the drive motor to the pawl, secure fixing of the worm gear is therefore necessary. This secure position of the worm gear is ensured by means of a metallic rotary axis. If for constructional and/or economic reasons usage of a metallic rotary axis of the worm gear is not possible or not sensible, use of another material is also possible.

If a pawl axis and/or a worm gear axis is accommodated at least unilaterally on the lock case and/or on a side opposite the lock case on a reinforcement plate, a further advantageous embodiment of the invention thus results. The lock case is of a sheet metal construction. The locking mechanism components are attached to the lock case. The axes of the pawl and/or the worm gear can be firmly attached to the lock case, so that the pawl and/or the worm gear can be rotated around the respective axis. A further possibility is to accommodate the pawl axis and/or the worm gear axis in or on the lock case, by means of a bearing bush. The pawl and/or the worm gear can be firmly connected to the respective axis. If the pawl axis and/or the worm gear axis are accommodated on the lock case by means of a bearing bush, a further bearing point is necessary on a reinforcement plate attached opposite the lock case. The pawl axis and/or the worm gear axis can also be accommodated in a bearing bush in the reinforcement plate.

In a further advantageous embodiment of the invention, the transmission stage is solely be activatable during operation of the pawl. It should hereby be expressed that the teeth of the gear wheel segment of the worm gear and the teeth of the pawl are not permanently engaged.

In the present invention, the pawl is engaged with the rotary latch in a locked locking mechanism of the lock. The gear wheel segment of the worm gear is located in a position in which the teeth of the gear wheel segment of the worm gear are about to engage with the teeth of the pawl. During the opening process of the lock, the electromotor is activated and initiates the opening torque via the worm into the worm gear. Whereupon the worm gear rotates so far until the teeth of the gear wheel segment of the worm gear engage with the teeth of the pawl, so that the worm gear can transmit the opening torque to the pawl by means of the gear wheel segment and thus the pawl releases the rotary latch. The rotary latch can now rotate and release the lock holder. According to the construction of the lock, the worm gear rotates in a clockwise or anti-clockwise direction during the opening process of the lock. No change in the rotational direction of the worm gear is preferably provided for during the lifecycle of the lock. This is however possible.

After the opening process, the worm gear rotates so far that the gear wheel segment of the worm gear disengages from the pawl. Thereupon the pawl is rotated by means of a spring in the opposite opening rotational direction until the pawl comes into contact with the rotary latch with its ratchet nose. The worm gear further rotates after the opening process by means of the electromotor in the opening rotational direction until the gear wheel segment has attained the position in which the teeth of the gear wheel segment of the worm gear are about to engage with the teeth of the pawl.

Disengagement of the teeth of the gear wheel segment of the worm gear and the teeth of the pawl is necessary in order to prevent initiation of a torque into the gear wheel segment of the worm gear by means of the pawl. As the pawl lies adjacent on the rotary latch by means of the spring, the pawl moves along during a rotational movement of the rotary latch due to the external contour of the rotary latch. Furthermore, the pawl moves during ratcheting of the ratchet nose in the main ratchet or pre-ratchet of the rotary latch. By means of this rotary movement of the pawl in the case of engagement of the teeth of the pawl with the teeth of the gear wheel segment a torque is initiated into the gear wheel segment of the worm gear. Damage to the pawl, worm gear and worm and/or the electromotor would thus be possible.

BRIEF DESCRIPTION OF DRAWINGS

Hereinafter the invention is explained in further detail with reference to the attached drawings on the basis of a preferred exemplary embodiment. However, the principle applies that the exemplary embodiments do not restrict the invention, but only constitute advantageous embodiments. The characteristics portrayed can be executed individually or in combination with other characteristics of the description.

The following are shown.

DETAILED DESCRIPTION

Figure 1:
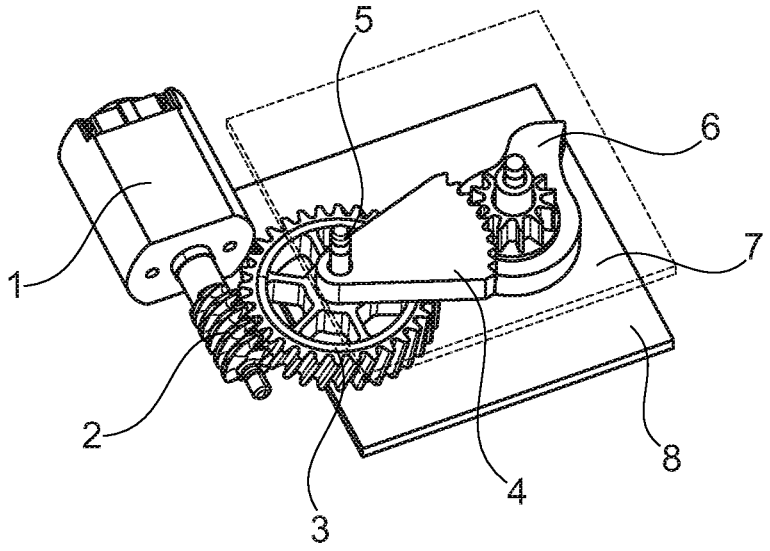
FIG. 1 a preferred exemplary embodiment of an isometric view of the electromotor, worm, worm gear and pawl occurring in a motor vehicle lock according to the invention. The isometric view shows the components necessary for functioning during a movement process, i.e. during movement of the pawl by the worm gear, FIG. 2 a front view of the functional unit in a "start position", i.e. at the start of the movement process if a pawl is disengaged from a rotary latch (not shown here), FIG. 3 the front view of the functional unit of the lock in an "end position", i.e. if the pawl is disengaged from the rotary latch, FIG. 4 the front view of the functional unit of the lock in an "equilibrium position", i.e. if the worm gear is disengaged from the pawl and FIG. 5 a top view of a pawl body with toothing. In addition to the pawl body and the toothing the rotary axis of the pawl can also be seen.

FIG. 1 shows a three-dimensional view of the components, that are necessary to explain the present invention, present in a motor vehicle lock according to the invention. The further components of a lock are dispensed with here for the sake of clarity. The locking system has an electromotor 1, a worm 2, a worm gear 3 with a gear wheel segment 4 and a rotary axis 5, a pawl 6, and the diagrammatic illustration of a reinforcement plate 7 and a lock plate 8.

In the functioning of a lock, a non-illustrated rotary latch and the pawl 6 interact with a lock holder which is also not illustrated. The lock holder is preferably attached to a motor vehicle chassis. The relative movement between the lock holder and the rotary latch causes the rotary latch to be pivoted and simultaneously for the pawl 6 to engage with the rotary latch.

In the present exemplary embodiment, a movement cycle of a lock can be described on the basis of the rotation of a worm gear 3 of up to 360° or 360° or more than 360°. The rotational direction of the worm gear 3 can depend on a number of factors, such as the type of lock or the installation direction in the lock. The rotational direction can be executed in both a clockwise and an anti-clockwise direction. During a movement cycle of the lock, generally no change of rotational direction of the worm gear 3 is provided for. However, due to the design a change in rotational direction of the worm gear 3 is possible.

Figure 4:
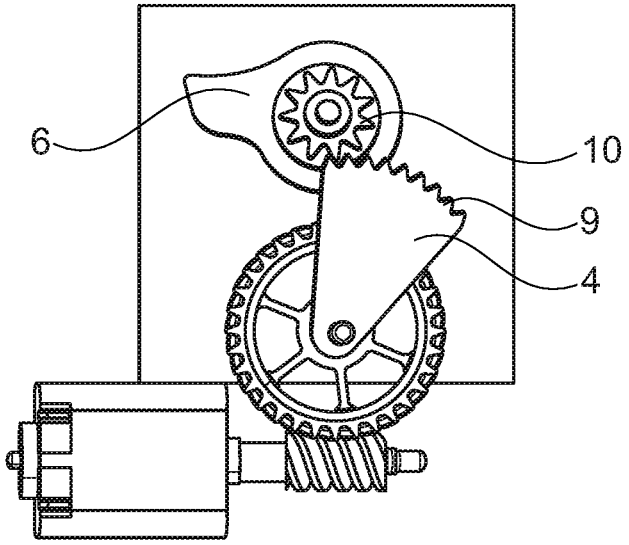

In the starting position of the movement cycle the gear wheel segment 4 of the worm gear 3, is viewed in a rotational direction, in a position in which the teeth 9 of the gear wheel segment 4 are about to engage with the teeth 10 of the pawl 6, however not yet engaged, as is apparent as an example in FIG. 4. The movement cycle can be sub-divided into an opening and a locking process.

Figure 2:
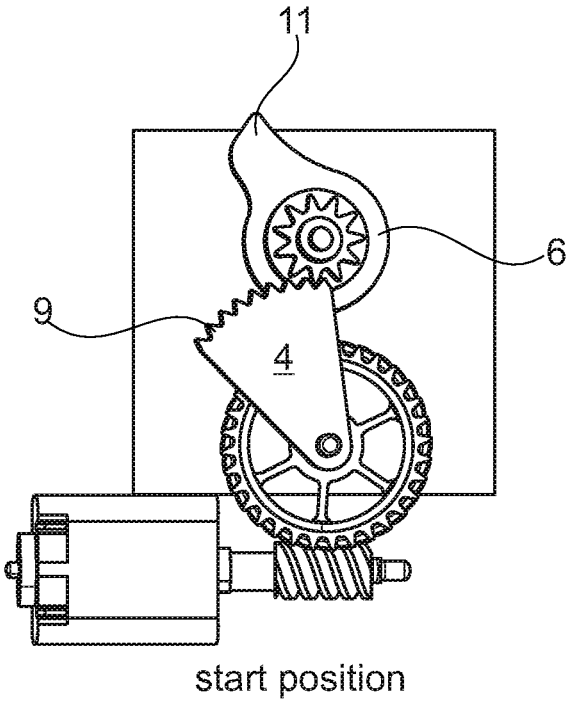

During an opening process of the lock the rotary latch releases the lock holder. In the opening process, an impulse acts on an electromotor 1, whereby the electromotor 1 transmits a drive torque via a worm 2 to the worm gear 3. Whereupon the gear wheel segment 4 on the worm gear 3 transmits the drive torque to the pawl 6. A ratchet nose 11 of the pawl 6 is subsequently disengaged from a main ratchet of the rotary latch. The start of the opening movement is shown in FIG. 2. In FIG. 2, the gear wheel segment 4 of the worm gear 3 is engaged with the pawl 6 and the pawl 6 engaged with the rotary latch. The position illustrated in FIG. 2 shall be defined here as the "start position" in which the opening movement begins and thus the ratchet nose 11 of the pawl 6 is disengaged from the main ratchet of the rotary latch.

Figure 3:
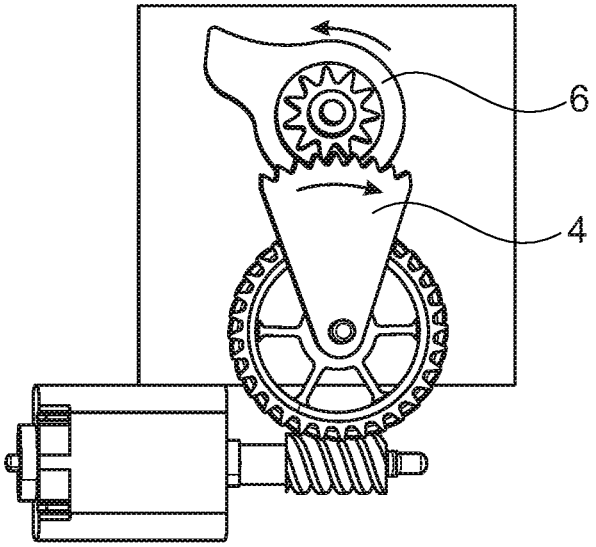

FIGS. 3 and 4 show the further progression of the opening movement. The pawl 6 is rotated by means of the drive torque until the ratchet nose 7 of the pawl 6 is neither engaged with the main ratchet of the rotary latch, nor engaged with a pre-ratchet. The pawl 6 and the gear wheel segment 4 of the worm gear 3 are still engaged. This position shall be defined here as the "end position". In the "end position" the rotary latch is aligned in such a way that the rotary latch releases the lock holder.

Figure 5:
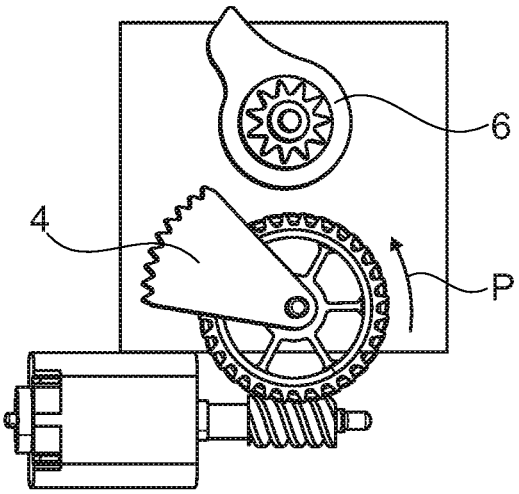

In the further rotational movement in the direction of the arrow P of the worm gear 3 by the drive torque, the gear wheel segment 4 of the worm gear 3 becomes disengaged from the pawl 6. The worm gear 3 then continues to rotate in the direction of movement until the worm gear 3 has attained the start position again. The pawl 6 is now disengaged from the rotary latch and disengaged from the gear wheel segment 4 of the worm gear 3; this can be viewed in FIG. 5.

In order to prevent an undefined rotational movement of the pawl 6 and to ensure an unintentional interlocking of the pawl 6 with the rotary latch, the pawl 6 is moved by means of a return spring against the opening rotational direction until the pawl 6 lies adjacent on the external contour of the rotary latch. During a subsequent locking process of the lock it is thus ensured that the ratchet nose 11 of the pawl 6 ratchets in the pre-ratchet or the main ratchet of the rotary latch.

In order to guarantee secure interlocking of the teeth 9, 19 of the gear wheel segment 4 of the worm gear 3 and the pawl 6 during an opening process, the external teeth 9 of the gear wheel segment 4 have a decreasing height progression of the teeth contours in the direction of movement at least. This has the advantage that on a gear wheel segment 4 which is only configured over an angle range on the worm gear 3, the engagement of the teeth 9 of the gear wheel segment 4 with the teeth 10 of the pawl 6 is facilitated. Damage to the teeth contours 9 of the gear wheel segment 4 and the pawl 6 is thus prevented.

Figure 6:
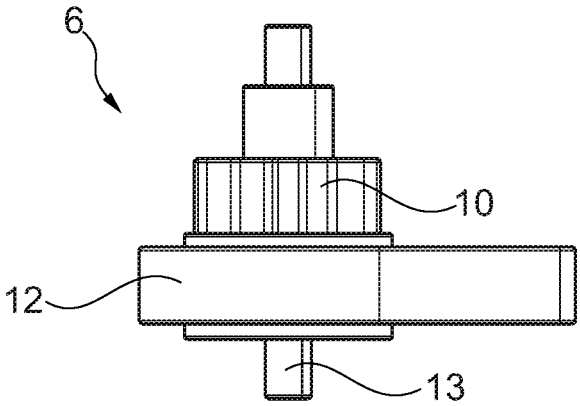
FIG. 6 a side view of a pawl body formed as a single component.

FIG. 6 shows the exemplary illustration of a pawl 6 formed as a single component, wherein the pawl body 12, the toothing 10 and the axis 13 consist of a single component. A single-component execution of the pawl 6 can be configured, for example, as a plastic component, a stamping component or a cast component, naturally a multiple component construction of the pawl 6 is also conceivable from the stated material.

LIST OF REFERENCE SYMBOLS

1. Electromotor
2. Worm
3. Worm gear
4. Gear wheel segment
5. Rotational axis
6. Pawl
7. Reinforcement plate
8. Latch plate
9. Teeth of the gear wheel segment
10. Teeth of the pawl
11. Ratchet nose
12. Pawl body
13. Axis

The invention claimed is:

1. A lock for a motor vehicle door, the lock comprising:
a locking mechanism with a rotary latch and at least one pawl that engages and disengages the rotary latch during a locking process and unlocking process of the lock,
a drive motor,
a worm connected to the drive motor,
a worm gear, wherein the worm gear can be driven by the drive motor and the worm, and
a gear stage for transmitting a torque from the worm gear to the pawl, wherein the gear stage is directly connected to each of the worm gear and the pawl during the unlocking process,
wherein the worm gear is driven in a same direction of rotation during both the unlocking process in which the pawl disengages the rotary latch and the locking process in which the pawl engages the rotary latch.

2. The lock according to claim 1, wherein the pawl has a pawl body and at least a sectoral toothing.

3. The lock according to claim 2, wherein the toothing is connected to the pawl in a positive-locking, force-fitting or permanently bonded manner.

4. The lock according to claim 2, wherein the toothing is formed as a single component with the pawl.

5. The lock according to claim 1, wherein the pawl consists of a metallic material and/or plastic.

6. The lock according to claim 1, wherein a plastic layer which is present at least sectorally encompasses a toothing of the pawl.

7. The lock according to claim 1, wherein the worm gear encompasses a gear wheel segment.

8. A lock for a motor vehicle door, the lock comprising:

a locking mechanism with a rotary latch and at least one pawl that engages and disengages the rotary latch during a locking process and unlocking process of the lock, a drive motor, a worm connected to the drive motor, a worm gear, wherein the worm gear can be driven by the drive motor and the worm, and a gear stage for transmitting a torque from the worm gear to the pawl, wherein the gear stage includes a gear wheel segment, wherein the worm gear is driven in a same direction of rotation during both the unlocking process in which the pawl disengages the rotary latch and the locking process in which the pawl engages the rotary latch, wherein the gear wheel segment is arranged parallel to the worm gear.

9. The lock according to claim 7, wherein the gear wheel segment is connected to the worm gear in a positive-locking, force-fitting or permanently bonded manner.

10. The lock according to claim 7, wherein the gear wheel segment is connected to the worm gear as a single component.

11. The lock according to claim 10, wherein the gear wheel segment extends over an angle range of 20°-120° of the gear wheel.

12. A lock for a motor vehicle door, the lock comprising:

a locking mechanism with a rotary latch and at least one pawl that engages and disengages the rotary latch during a locking process and unlocking process of the lock, a drive motor, a worm connected to the drive motor, a worm gear, wherein the worm gear can be driven by the drive motor and the worm, and a gear stage for transmitting a torque from the worm gear to the pawl, wherein the gear stage includes a gear wheel segment, wherein the worm gear is driven in a same direction of rotation during both the unlocking process in which the pawl disengages the rotary latch and the locking process in which the pawl engages the rotary latch, wherein a toothing of a gear wheel segment of the worm gear is formed such that the toothing of the gear wheel segment and a toothing on the pawl are engageable.

13. The lock according to claim 7, wherein the worm gear and the gear wheel segment consist of a metallic material and/or a plastic.

14. The lock according to claim 1, wherein the worm gear has a metallic rotary axis.

15. The lock according to claim 1, wherein an axis of the pawl and/or an axis of the worm gear, is accommodated at least unilaterally on a lock case and/or on a side opposite the lock case on a reinforcement plate.

16. The lock according to claim 1, wherein the gear stage is only activatable during operation of the pawl.

17. The lock according to claim 5 wherein the pawl consists of a metallic pawl body with an at least sectoral plastic layer.

18. The lock according to claim 5, wherein the pawl consists of a stamped or injection-molded part.

19. The lock according to claim 13, wherein the plastic is polyoxymethylene (POM).

20. The lock according to claim 12, wherein reduced toothing is formed on the gear wheel segment.

* * * * *